United States Patent [19]

Jansen

[11] 4,285,102

[45] Aug. 25, 1981

[54] DOCUMENT CLAMPING DEVICES

[76] Inventor: Raymond K. Jansen, 10, Dylan Close, Llandough, Penarth, Glamorgan, Wales

[21] Appl. No.: 18,791

[22] Filed: Mar. 8, 1979

[30] Foreign Application Priority Data

Mar. 11, 1978 [GB] United Kingdom ..... 9706/78

[51] Int. Cl.[3] ..... B65D 67/02

[52] U.S. Cl. ..... 24/17 R; 24/17 A; 24/30.5 R; 292/204

[58] Field of Search ..... 24/17 R, 17 A, 16 R, 24/16 PB, 30.5 R; 292/15, 204

[56] References Cited

U.S. PATENT DOCUMENTS

| | | | |
|---|---|---|---|
| 448,614 | 3/1891 | Haskins | 24/30.5 R |
| 520,107 | 5/1894 | Engel | 24/30.5 R |
| 562,462 | 6/1896 | Groo | 24/17 A |
| 775,801 | 11/1904 | Danielson | 24/30.5 R |
| 1,506,463 | 8/1924 | Turnbull | 24/17 R |
| 1,871,263 | 8/1932 | Farley | 24/17 R |
| 2,595,436 | 5/1952 | Abdallah et al. | 292/204 |
| 3,129,024 | 4/1964 | Schuessler et al. | 292/15 |
| 3,300,805 | 1/1967 | Rizzo | 24/16 R |
| 3,517,702 | 6/1970 | Mueller et al. | 24/16 PB |
| 3,735,449 | 5/1973 | Rosales | 24/16 PB |

FOREIGN PATENT DOCUMENTS 1362270 8/1974 United Kingdom .

*Primary Examiner*—Victor N. Sakran

*Attorney, Agent, or Firm*—Young & Thompson

[57] ABSTRACT

A document clamping device formed from a series of pivotally interconnected links. Adjacent pairs of links are movable between a first position of mutual alignment and a second position at right angles to one another about a pivot. Locking means are provided to hold the links firmly in the second position and preferably also in the first position. This locking means may be in the form of spring-loaded ball catches or resilient bosses on one link locating within recesses on the other link of a pair. Pivoting may be achieved either by means of a pivot pin or by mutually engaging configurations on the interconnected ends of two adjacent links.

7 Claims, 8 Drawing Figures

DOCUMENT CLAMPING DEVICES

BACKGROUND OF THE INVENTION

This invention is concerned with a device for clamping together a sheaf of documents such as a bundle of letters. Existing clamping devices include such items as paper clips, rubber bands and bulldog clips. Paper clips are too small to cope with thick bundles of documents and rubber bands tend to buckle and bundle and can break without warning. Indeed, none of these existing devices are sufficiently versatile to be usable with bundles of documents of widely varying thicknesses.

It is an object of this invention to provide a clamping device which can be readily used to grip document bundles of varying thicknesses.

SUMMARY OF THE INVENTION

Accordingly, this invention provides a document clamping device comprising a series of links pivotally interconnected so that each adjacent pair of links may be moved between a first position where they are in or approach mutual alignment and a second position where they are substantially at right angles to one another, locking means being provided to hold the links in at least the second position.

Such a device can be constructed from a large number of very short links and the whole device can be bent into a U-shape by moving two pairs of links into the second position. Thus the distance between the arms of the U can readily be varied depending upon the thickness of the bundle of documents to be gripped.

It is preferred that the locking means should also be effective to hold the links in the first position so that each of the three segments of the U still comprise a substantially straight and reasonably rigid arm.

The locking means may comprise individually operable locking devices but it is preferred that the locking should be achieved automatically when the links are moved into a link position holding condition.

Thus biassing means may be incorporated to bias the locking means into the link position holding condition. This biassing could thus be one or more springs. In one preferred embodiment the or each spring acts on a ball catch in one link which will locate within a recess in the other link of a pair when the links are in the second position. Where the locking means is also effective to hold the links in the first position, a further spring loaded ball catch could be provided to hold the links in the first position. Alternatively, a further recess could be provided in the other link of the pair for receipt of a ball catch when the links are in the first position.

In one preferred construction one of the links carries an arcuate portion whose centre of radius is the pivot point of the link and whose ends carry separate parts of the locking means for holding the links in the respective first and second positions.

In a further preferred embodiment the locking means comprises a boss or bosses on one link co-operating as a snap fit with a recess or recesses on an adjacent link. Thus the end of one link can have a head carrying the boss or bosses which is pivotally held within an opening in an adjacent link. Additionally the head may carry one or more projections which abut part of the adjacent link when the two links are moved into mutual alignment. As an alternative construction, the two adjacent links may be interconnected by a pivot member.

The clamping member may comprise a series of short links or long links with strategically positioned sets of short links between pairs of long links.

The individual links or the whole clamping device could be formed from a moldable plastics material or could be covered by a protective sleeve or plastics or other convenient material.

DESCRIPTION OF THE DRAWINGS

The invention may be performed in various ways and preferred embodiments thereof will now be described, by way of example, with reference to the accompanying drawings, in which:

The clamping device shown in FIGS. 1 to 4 comprises a series of links 1 which are pivotally interconnected in a series by means of pivot pins 2. As shown in FIG. 3 the extreme end 3 of one link is provided with a pair of spring-loaded ball catches 4 biased by an internal spring 5. The other end 6 of each link 1 incorporates an arcuate portion 7 terminating in a straight return portion 8 which lies perpendicular to the length of the links. A hole 9 is provided at the end of the return portion for receipt of the pivot pin 2 and the arcuate portion 7 is provided with a pair of recesses 10 which will receive the ball catches 4 when the links 1 are alternatively oriented in the conditions A and B shown in FIG. 1. When the end 3 of the link 1 is being moved between the two recesses 10 the ball catches 4 will be compressed inwardly of the passageway formed in the end 3 of the link 1 and will snap into position when a recess 10 is reached. Thus the links 1 will be held substantially rigidly in either of the conditions A or B and the clamping device can be formed into a substantially rigid U-shape for the purpose of gripping bundles of documents between the arms of the U.

As shown in FIG. 4, the ball catches 4 could be retained within seats 11 formed at the respective ends of the arcuate portion 7 of one link 1 and in this case locating recesses 12 for the ball catches 4 would be formed in the end 3 of the other link 1.

A flexible plastics sleeve could be formed over the length of the clamping device to provide protection for the respective links and to cover sharp corners which might otherwise cause damage to the user.

Figure 1:
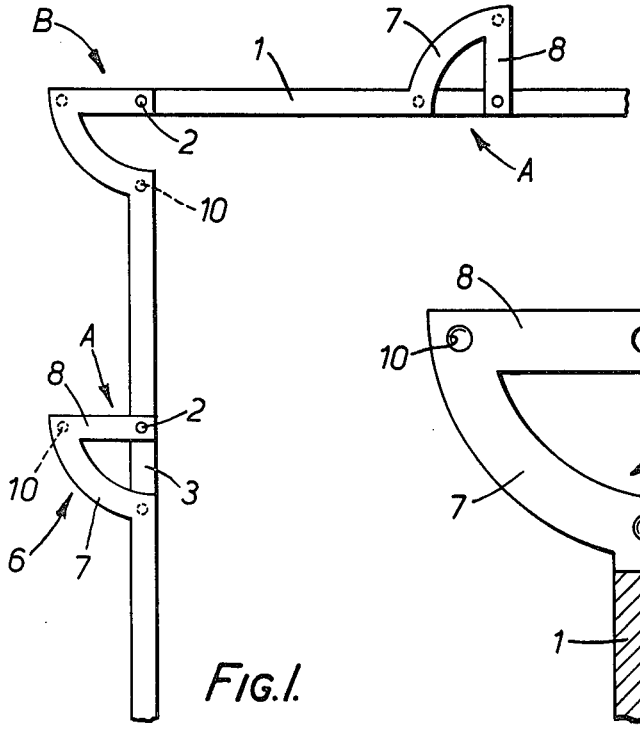
FIG. 1 is a side view of a portion of one form of clamping device according to this invention.
Figure 2:
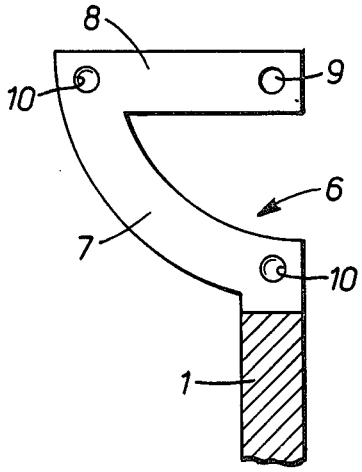
FIG. 2 is a vertical cross-section through the top end of one of the links of the device shown in FIG. 1.
Figure 3:
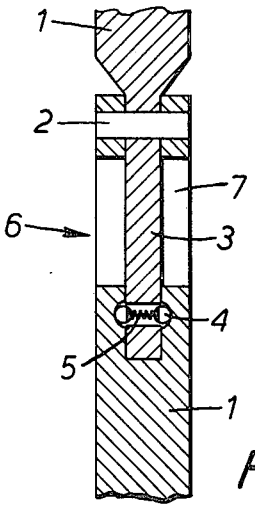
FIG. 3 is a vertical cross-section through two of the links illustrated in FIG. 1 showing the means for interconnecting them.
Figure 4:
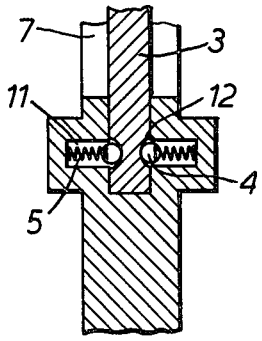
FIG. 4 is a vertical cross-section through an alternative means of interconnection of two links.
Figure 5:
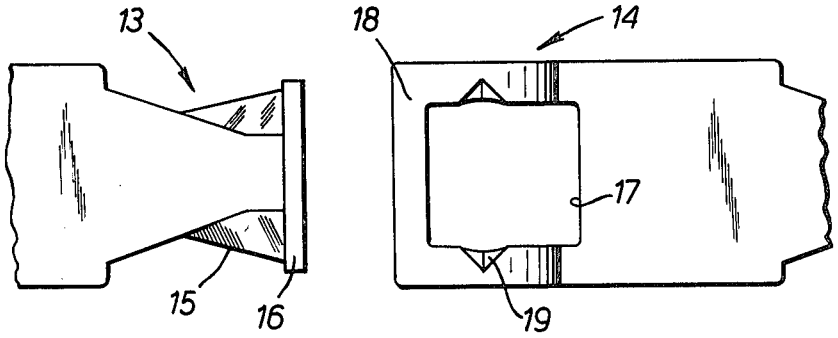
FIG. 5 is an exploded view of parts of two links of an alternative form of clamping device of the invention.

The construction of the device may be modified in various ways thus, for instance, the ball catches 4 could be replaced by bosses which will form a snap fit into corresponding recesses (e.g., the recesses 10) in the upper portion. There could be a shallow track joining the recesses 10 shown in FIG. 2 which will allow for relatively free movement of the bosses between the two locking positions. Furthermore, the pivot pin 2 could be replaced by bosses in one member which will locate within corresponding recesses in the other member, although ideally these bosses should be somewhat larger than the bosses provided for the locking function so that there will be little possibility for the two links to come apart at the pivot position. With this alternative pivoting arrangement it is possible for the clamp to be increased or reduced in length as desired by adding or removing a few links. Where it is envisaged that the clamp will be used for clamping a relatively thick bundle of documents, for instance, it could be formed with a central leg whose length approaches the expected bundle minimum thickness, the remainder of the clamping device being formed from a series of short links at either end.

If the links are relatively narrow there is a possibility that they could cut into documents when the device is clamped tightly about the document bundle. This problem could be overcome, however, by forming flanges to the sides of each link which will effectively broaden the contact area and reduce the possibility of damage.

It is of course possible for the series of links to be bent beyond a C-shape, thus into an O-shape and where the links are readily interconnected with one another, a complete loop could be formed which could be used as a connector member, for example to interconnect groups of items in a shipping container (each of which is provided with an aperture through which the clamping device can be passed) and thus segregate the groups from one another.

Figure 6:
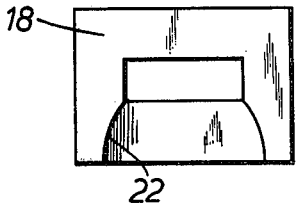
FIG. 6 is an end view of one of the link parts shown in FIG. 5.
Figure 7:
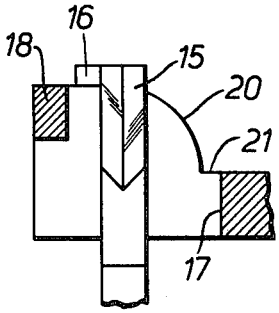
FIGS. 7 and 8 are cross-sections through two interconnected links of FIG. 5 in alternative attitudes.
Figure 8:
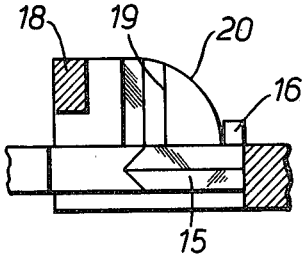

An alternative form of clamping device is illustrated in FIGS. 5 to 8 of the accompanying drawings. In this form of device each link has the forward end illustrated by the part 13 in FIG. 5 and a rearward end illustrated by the part 14. The part 13 incorporates a neck portion having outwardly inclined walls 15 terminating in a projecting rib 16. The part 14 is provided with an opening 17 having a raised rearward wall 18 which extends around three sides, the two facing walls incorporating notches 19 which will receive the inclined walls (or bosses) 15. Interconnection of parts 13 and 14 of adjacent links is achieved by inserting the part 13 from below into the opening 17 (the rear part of wall 18 being partially cut away as shown in FIG. 6 to provide adequate access). The part 13 will then be twisted so that the bosses 15 snap into the recesses 19 to achieve the attitude illustrated in FIG. 7. This secures two adjacent links at right angles to one another and pressure can be exerted to cause the bosses 15 to snap out of the recesses 19 whereupon the link carrying the part 13 can be pivoted so that the projecting rib 16 travels around the curved portion 20 of the upstanding wall 18 of the part 14. Eventually the projecting rib 16 will abut against the wall 21 of the part 14 thus preventing further rotation of the part 13 which will project rearwardly (in alignment wih the link carrying part 14) through the opening 22 in the rear of the part 14. Thus a pair of adjacent links can be moved from the conditions of mutual alignment as shown in FIG. 8 to positions, where they are locked by the resilience of the bosses 15 in the recesses 19, at right angles to one another. This arrangement has the advantages that no additional mechanical parts such as ball-catches are needed and a string of links of any length can readily be constructed.

It is envisaged that the arrangement incorporating the spring loaded ball-catches would be best suited for heavy duty uses where large bundles have to be gripped securely. Of course all the embodiments may be modified to suit particular requirements and in particular, in the arrangement shown in FIGS. 5 to 8 the part 13 could be formed with recesses which would co-operate with bosses projecting into the opening 17 of the part 14.

I claim:

1. A document clamping device comprising a series of generally elongate links pivotally interconnected so that each adjacent pair of links is movable between a first position where they at least approach mutual alignment and a second position where they are substantially at right angles to one another, first locking means effective to hold the links in the first position, second locking means effective to hold the links in the second position, and an arcuate portion carried by one of the links, the centre of radius of the arcuate portion being at the pivot point of the link, end portions of the arcuate portions carrying separate parts of the respective first and second locking means for holding the links in the respective first and second positions.

2. A clamping device according to claim 1, wherein respective biassing means are incorporated to bias each locking means into the link position holding condition.

3. A clamping device according to claim 2, wherein each biassing means comprises at least one spring and each spring acts on a ball catch in one link which will locate within a recess defined in the other link of a pair when the links are in one of the two positions.

4. A clamping device according to claim 1 which comprises a series of long links with strategically positioned sets of short links between pairs of long links.

5. A document clamping device comprising a series of generally elongate links pivotally interconnected so that each adjacent pair of links is movable between a first position where they at least approach mutual alignment and a second position where they are substantially at right angles to one another, locking means being provided to hold the links in the second position, the locking means comprising at least one boss on one link, each movable into a position to cooperate as a snap fit within a corresponding recess in an adjacent link, the end of one link comprising a head carrying each boss, the head being pivotally held within an opening defined in an adjacent link, and at least one projection carried by the head which abuts part of the adjacent link when the two links are moved into the first position of mutual alignment.

6. A clamping device according to claim 5, wherein the two adjacent links are interconnected by a pivot member.

7. A clamping device according to claim 5 which comprises a series of long links with strategically positioned sets of short links between pairs of long links.

* * * * *